United States Patent [19]

Hall et al.

[11] 4,451,068

[45] May 29, 1984

[54] ENGRAVED IMAGE IDENTIFICATION CARD WITH OPAQUE COVER LAYER

[75] Inventors: John S. Hall; Barry C. Phelps, both of Sacramento, Calif.

[73] Assignee: California Interface and Software Limited Partnership, Sacramento, Calif.

[21] Appl. No.: 330,348

[22] Filed: Dec. 14, 1981

[51] Int. Cl.[3] ..... B42D 15/00

[52] U.S. Cl. ..... 283/75; 283/91; 283/94; 283/110; 283/111; 283/904

[58] Field of Search ..... 283/7, 8 R, 9 R, 75, 283/91, 94, 110, 111, 77, 904; 356/71; 40/2.2, 626

[56] References Cited

U.S. PATENT DOCUMENTS

| | | | |
|---|---|---|---|
| 3,871,119 | 3/1975 | Mayer | 40/2.2 |
| 3,897,964 | 8/1975 | Oka et al. | 283/7 |
| 3,919,447 | 11/1975 | Kilmer, Jr. et al. | 283/8 R X |
| 3,930,924 | 1/1976 | Oka et al. | 283/7 X |
| 3,950,608 | 4/1976 | Noda et al. | 358/256 |
| 4,052,739 | 10/1977 | Wada et al. | 358/299 |
| 4,151,666 | 5/1979 | Raphael et al. | 283/7 X |

*Primary Examiner*—Fred Silverberg

*Attorney, Agent, or Firm*—Nilsson, Robbins, Dalgarn, Berliner, Carson & Wurst

[57] ABSTRACT

An engraved image identification card has a translucent planar base member with a multiplicity of engraved scores extending into one of its surfaces with an opaque layer positioned adjacent either the engraved side of the translucent member or the non-engraved side of the translucent member opposite the engraved side to provide enhancement of the contrast between the engraved and non-engraved regions in the translucent member.

7 Claims, 3 Drawing Figures

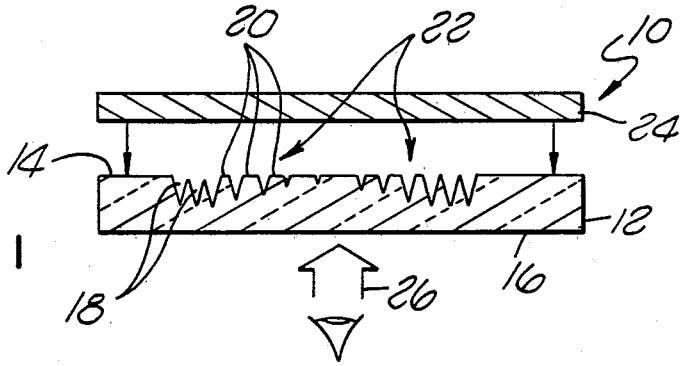
FIG. 1
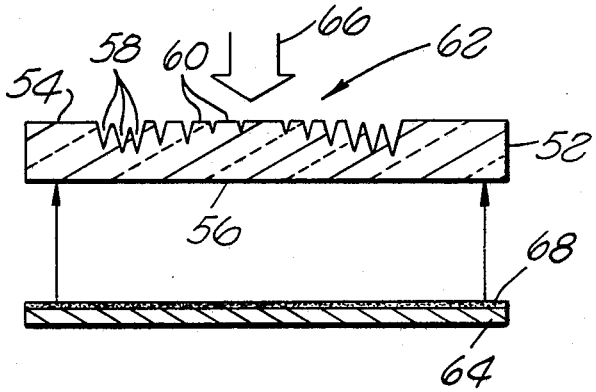
FIG. 2
FIG. 3
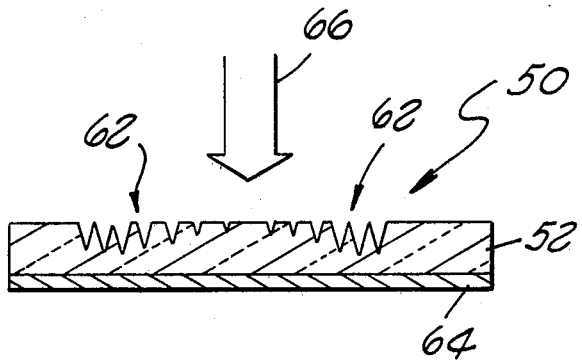

ENGRAVED IMAGE IDENTIFICATION CARD WITH OPAQUE COVER LAYER

BACKGROUND OF THE INVENTION

This invention relates to machine engraved identification cards and in particular to machine engraved identification cards having an engraved translucent member with an opaque or colored layer positioned adjacent to one of the major surfaces of the engraved translucent member.

Engraved identification cards can be made utilizing any one of a number of available electronic engraving systems such as the system disclosed in Noda, et al., U.S. Pat. No. 3,950,608, Wada, et al., U.S. Pat. No. 4,052,739, or any other similar engraving system. Utilizing such electronic engraving systems, images can be engraved in blank dual layered cards by making a multiplicity of scores through one opaque colored plastic layer of the card blank into a second different colored opaque plastic layer of the card blank. By altering the depth of the scoring, the width of the region between scores can be continuously varied to generate the light and dark regions which combine to make up the desired image.

A complete description of such prior art identification cards and the method of making them is disclosed in Oka, et al., U.S. Pat. No. 3,897,964 and Oka, et al., U.S. Pat. No. 3,930,924.

Such prior art identification cards require an opaque base of one color overlaid with an opaque layer of a contrasting color so that light impinging on the engraved surface of the card is variably reflected back to the eye of the observer according to the location and amount of the the bottom layer which is exposed by the engraving. Engraving into a single colored layer or into a translucent layer without providing similar scoring through an adjacent contrasting layer has not been heretofore attempted because the low contrast between the engraved and non-engraved regions prevent the engraved image from being easily observed.

The present invention overcomes this low contrast problem by enhancing the contrast in an engraved single layer translucent base member. This enhanced contrast is provided by affixing or otherwise positioning a colored member to either the engraved or non-engraved surface of the engraved translucent member after the engraving has been performed. The contrasting colored layer, whether itself translucent or opaque, enhances the contrast between the engraved regions, which appear as frosted regions on the translucent base member, and the non-engraved regions.

SUMMARY OF THE INVENTION

An engraved identification card in accordance with the invention includes a translucent planar member having a first major surface and a second major surface opposite the first major surface. The first major surface has an image engraved therein defined by engraved regions and non-engraved regions. The engraved regions and non-engraved regions combine to generate an observed image of the translucent planar member. The invention further comprises a colored planar member which is positioned to cover one of the first and second major surfaces for enhancing the observable contrast between the non-engraved and the engraved regions whereby the observed image is more readily seen. The colored member is preferably non-engraved.

In one embodiment, the colored planar member is positioned over the first or engraved surface. In such an embodiment it is preferable, although not necessary, that the engraved image be the mirror image of the image desired to be observed since observation will occur from the "back side" or second non-engraved major surface of the translucent member.

Alternatively, the colored planar member may be positioned over the non-engraved second surface. The colored planar member and the translucent planar member may be permanently affixed to one another by either a suitable adhesive or by heat bonding.

BRIEF DESCRIPTION OF THE DRAWINGS

A complete understanding of the present invention and of the above and other advantages thereof may be gained from a consideration of the following description of the preferred embodiments taken in conjunction with the accompanying drawings in which:

FIG. 1 is an exploded side view of an engraved identification card with an opaque layer affixed to cover the engraved surface in accordance with the invention;

FIG. 2 is an exploded side plan view of an engraved identification card where the opaque layer is affixed to the major surface opposite the engraved surface;

FIG. 3 is a side plan view of the identification card of FIG. 3.

DETAILED DESCRIPTION

Referring initially to FIG. 1, an engraved identification card 10 in accordance with one embodiment of the invention includes a translucent planar member which is made from an engravable material such as polyvinyl chloride (PVC). The translucent member or layer 12 has a first major surface 14 and a second major surface 16 opposite the first major surface 14. A plurality of scores or depressions are made into the first surface 14 to define a plurality of engraved regions 18 in the first major surface 14. The engraved regions 18 define scores of varying widths along the first major surface 14 with non-engraved regions 20 being located adjacent to the engraved regions 19. The plurality of engraved regions 18 and non-engraved regions 20 combined to form an engraved image 22 in the first major surface 14.

Any of a number of electronic engraving systems and methods may be used to engrave the card 10. Two such systems are disclosed in Noda, et al., U.S. Pat. No. 3,950,608 and Wada, et al., U.S. Pat. No. 4,052,739.

It is to be emphasized that the translucent member 12 does not have an opaque or colored layer but rather is entirely translucent. Thus, the engravings do not extend through an opaque or colored layer into a translucent or different colored layer but rather simply extend into the translucent member 12. The resultant engraved regions 18 appear as lightly frosted regions in the first surface 14, and the non-engraved regions 20 appear as unfrosted regions. The engraved image is defined by the contrast between the frosted and unfrosted (engraved and non-engraved) regions. It will be appreciated that the resultant engraved image can be viewed only with some difficulty since there is only a slight difference in contrast between the non-engraved regions and the engraved regions.

In order to increase the contrast in accordance with the invention, a colored or opaque member 24, which may be a black opaque PVC material, is positioned adjacent the first major surface 14 covering the engraved image 22. The member 24, which itself is preferably not engraved thus enhances the contrast between the non-engraved regions 20 and the engraved regions 18 when positioned over the engraved image 22.

In this embodiment, the engraved image 22 must be viewed by looking at the second major surface 16. Therefore, the image observed by the viewer (observed image 26) will be the mirror image of the engraved image 22. In order that the observed image 26 not be a mirror image, the image data stored in the processing apparatus must be inverted utilizing well-known data inversion routines. Alternatively, mirror image data can be initially stored in the processor by storing the reflection of an object such as by viewing the object through a mirror.

In one embodiment, the colored or opaque member 24 may be adhesively affixed to the first major surface 14 so that the positioning of the colored member 24 is permanent. However, if an adhesive is utilized between the first major surface 14 and the member 24 it is preferred that the adhesive not fill-in the engraved regions since such a filling would greatly decrease the contrast between the engraved and non-engraved regions thereby decreasing the effectiveness of the colored member 24 in enhancing the contrast. Therefore, the adhesive is preferably selected to have a viscosity which prevents the adhesive from flowing. In addition the quantity of adhesive applied is limited so that the adhesive does not flow into the engraved regions. Of course, other techniques of bonding the colored member 24 to the translucent member 12 such as heat fusing may be utilized without departing from the invention.

Referring to FIGS. 2 and 3, another embodiment of an engraved identification card 50 in accordance with the invention is illustrated wherein a translucent member 52 has a first major surface 54 on one of its sides and a second major surface 56 on its other side. The first major surface 54 has a plurality of scores or other depressions comprising a plurality of engraved regions 58 and a plurality of non-engraved regions 60. The engraved regions 58 and the non-engraved regions 60 combined to define an engraved image 62 in the first major surface 54 as previously described in conjunction with FIG. 1.

In order to enhance the contrast between the engraved and non-engraved regions, a colored or opaque member 64 is positioned adjacent the second major surface 56 opposite the engraved regions. The colored or opaque member 64, is preferably not engraved and may be permanently affixed to the translucent member 52 by any suitable means such as by heat bonding or bonding with an adhesive such as adhesive 68. The resultant structure illustrated in FIG. 3 is viewed from the first major surface 54 so that the observed image 66 has the same orientation as the engraved image 62, that is, the observed image is not the mirror image of the engraved image as was the case in the embodiment shown in FIG. 1.

While the above embodiments are illustrative of the present invention, various modifications and changes can be made without departing from the spirit of the invention in its broader aspects.

What is claimed:

1. A two-layer engraved identification card comprising:

a translucent, single layer, planar member having a first major surface and a second major surface opposite the first major surface, the first major surface having an image engraved therein to define engraved regions and non engraved regions for generating an observed image on the translucent planar member the engraved regions being entirely contained in the translucent single layer planar member; and a non-engraved opaque planar member abutting directly against and covering one of the first and second major surfaces for enhancing the contrast between the non-engraved and the engraved regions whereby the observed image is more readily seen, the other of the first and second major surfaces being completely uncovered.

2. The engraved identification card of claim 1 wherein the non-engraved opaque planar member is positioned over the first surface.

3. The engraved identification card of claims 1 or 2 wherein the engraved image is the mirror image of the observed image.

4. The engraved identification card of claim 1 wherein the non-engraved opaque planar member is positioned over the second surface.

5. The engraved identification card of claims 1, 2 or 4 wherein the non-engraved opaque planar member is permanently affixed to the translucent planar member.

6. The engraved identification card of claim 3 wherein the non-engraved opaque planar member is permanently affixed to the translucent planar member.

7. The engraved identification card of claim 5 further comprising an adhesive between the non-engraved opaque planar member and the translucent planar member for permanently affixing the non-engraved opaque planar member and the translucent planar member together.

* * * * *

UNITED STATES PATENT AND TRADEMARK OFFICE

CERTIFICATE OF CORRECTION

PATENT NO. : 4,451,068

DATED : May 29, 1984

INVENTOR(S) : John S. Hall et al.

It is certified that error appears in the above-identified patent and that said Letters Patent is hereby corrected as shown below:

Column 2, line 29, "FIG. 3" should read -- FIG. 2 --.

Column 2, line 44, "19" should read -- 18 --.

Signed and Sealed this

*Twelfth* Day of *March 1985*

[SEAL]

*Attest:*

DONALD J. QUIGG

*Attesting Officer* *Acting Commissioner of Patents and Trademarks*